US005521383A

United States Patent [19]

Furukawa et al.

[11] Patent Number: 5,521,383

[45] Date of Patent: May 28, 1996

[54] CORONA DISCHARGE DEVICE

[75] Inventors: Kazuhiko Furukawa, Tenri; Toshiaki Kagawa, Sakurai; Syogo Yokota, Fujiidera; Hiroyuki Sawai, Nabari; Toshihiro Tamura, Shiki-gun; Hiroshi Ishii, Kashihara, all of Japan

[73] Assignee: Sharp Kabushiki Kaisha, Osaka, Japan

[21] Appl. No.: 259,657

[22] Filed: Jun. 14, 1994

[30] Foreign Application Priority Data

Jun. 18, 1993 [JP] Japan ..... 5-147755
Sep. 28, 1993 [JP] Japan ..... 5-240214

[51] Int. Cl.[6] ..... H01T 19/04

[52] U.S. Cl. ..... 250/324; 361/230

[58] Field of Search ..... 250/324, 325, 250/326; 361/230, 229

[56] References Cited

U.S. PATENT DOCUMENTS

| | | | |
|---|---|---|---|
| 3,240,994 | 3/1966 | Stuetzer | 361/229 |
| 3,900,735 | 8/1975 | Jahn | 250/324 |
| 4,088,891 | 5/1978 | Smith et al. | 250/324 |
| 5,128,547 | 7/1992 | Pfaff | 250/324 |
| 5,182,694 | 1/1993 | Endo | 361/229 |
| 5,313,184 | 5/1994 | Greuter et al. | 338/21 |

FOREIGN PATENT DOCUMENTS

| | | |
|---|---|---|
| 63-15272 | 1/1988 | Japan . |
| 5-2314 | 1/1993 | Japan . |

*Primary Examiner*—Jack I. Berman
*Assistant Examiner*—Kiet T. Nguyen
*Attorney, Agent, or Firm*—David G. Conlin; Kevin J. Fournier

[57] ABSTRACT

A corona discharge device includes a plurality of discharge electrodes each having a pointed tip for concentrating electric field, a plurality of resistors and a common electrode, each of the plurality of resistors connects corresponding one of the plurality of discharge electrodes to the common electrode, and causes a prescribed voltage drop within a range of from 200 V to 2000 V.

12 Claims, 13 Drawing Sheets

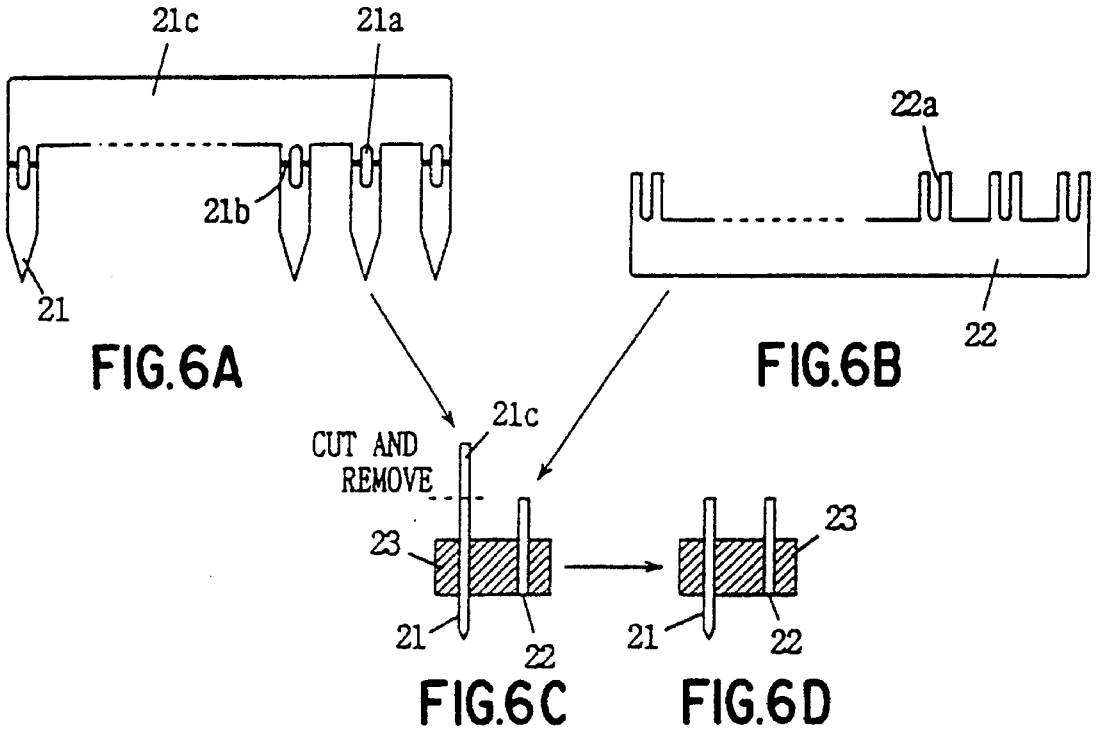
FIG.6A FIG.6B FIG.6C FIG.6D
F I G. 7
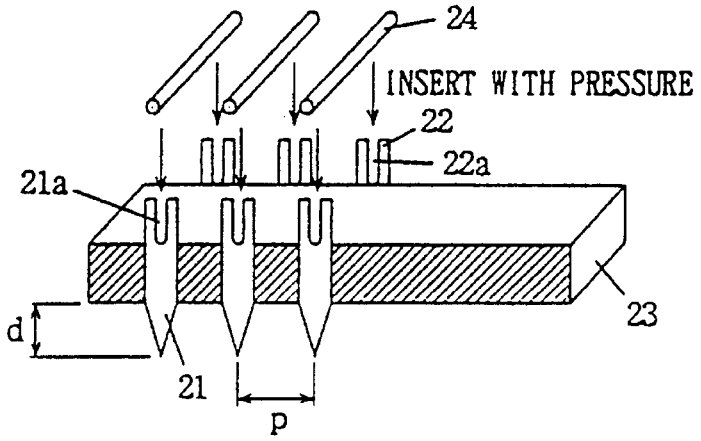

CORONA DISCHARGE DEVICE

BACKGROUND OF THE INVENTION

1. Field of the Invention

The present invention relates to a corona discharge device for uniformly charging a dielectric surface and, more specifically, to an improvement of a corona discharge device preferably used in an electrophotographic apparatus.

2. Description of the Related Art

A corona discharge device may be used as a charging device for generating a prescribed electrostatic potential on an image forming surface of an electrophotographic apparatus, for example. In one example of a conventional corona discharge device, a high voltage of 5 to 10 kV is applied to a large number of tungsten wires having the diameter of 50 to 100 μm, ions generated by discharge from these wires are moved onto the image forming surface, whereby the image forming surface is charged.

However, when negative discharge is carried out in this wire type corona discharge device, discharge takes place at random points on these wires dependent on the states of the number of wires, resulting in uneven and instable discharge with respect to the dielectric surface. Therefore, in order to uniformly charge the dielectric surface, a shield case as an auxiliary electrode or a grid electrode for controlling potential is used. However, despite of such improvements, much discharging current must be used in the wire type corona discharge device in order to obtain good stability and uniformity of charges. As a result, amount of ozone generated in the electrophotographic apparatus increases, causing degradation of image quality and possible adverse effect on human body.

Meanwhile, recently, a corona discharge device has been proposed in which a saw-tooth or needle like discharge electrode is used instead of the tungsten wires, as disclosed, for example, in Japanese Patent Laying-Open No. 63-15272. In the saw-tooth type corona discharge device, discharge points are regularly arranged at tips of a plurality of saw teeth, and therefore discharge becomes more uniform with respect to the dielectric surface. In addition, in the saw-tooth type discharge device, discharge current necessary for generating uniform static electrification is smaller than in the wire type discharge device, structural strength is relatively high, and the amount of undesirable ozone generated can be reduced.

FIG. 20 schematically shows a conventional corona discharge device. In the corona discharge device, a saw-tooth discharge electrode 51 formed of stainless steel is mounted on an insulator substrate 52. Saw-tooth discharge electrode 51 includes 10 electrode teeth 51*a* arranged at a pitch of 2 mm. Opposing to saw-tooth discharge electrode 51, a counter electrode 53 formed of stainless steel is placed spaced apart by a prescribed distance g from the tips of electrode teeth 51*a*. A high voltage source 54 is connected to saw-tooth discharge electrode 51. By applying a high voltage from high voltage source 54 to saw-shaped discharge electrode 51, corona discharge occurs from the tips of electrode teeth 51*a* to counter electrode 53.

Table 1 shows results of measurement of discharge current flowing through respective electrode teeth 51*a* when discharge takes place in the corona discharge device of FIG. 20. In this measurement, a voltage of −4.3 kV was applied to discharge electrode 51, and the space between discharge electrode 51 and counter electrode 53 was g=7 mm. The left column of Table 1 represents the number of electrode tooth 51*a* from the left, and the right column represents the discharge current flowing between the corresponding electrode tooth 51*a* and counter electrode 53.

TABLE 1

| Electrode Tooth No. (from Left) | Discharge Current (μA) |
|---|---|
| 1 | 1.90~2.20 |
| 2 | 0.1 |
| 3 | 0.30~0.80 |
| 4 | 1.20~1.90 |
| 5 | 1.1 |
| 6 | 0.30~0.38 |
| 7 | 0 |
| 8 | 0.48~0.54 |
| 9 | 0.18 |
| 10 | 0.80~1.20 |

In such a corona discharge device as shown in FIG. 20, discharge occurs at equal interval from the tips of electrode teeth 51*a* arranged at a prescribed pitch. However, as can be seen from Table 1, discharge current from the electrode teeth 51 varies considerably, resulting in instable discharge. Possible cause of such instability of discharge at respective electrode teeth 51*a* may be variation in fine configuration, defects, contamination and so on at each of the electrode teeth 51*a*. Accordingly, even when such a saw-tooth discharge electrode as shown in FIG. 20 is used, a considerable discharge current must be used in order to uniformly charge the dielectric surface. Though the amount of ozone generated in the saw-tooth type discharge device can be reduced to one fifth that of the wire type discharge device (when the discharge current is the same between the two types), further reduction of the amount of generated ozone is desired.

Japanese Patent Laying-Open No. 5-2314 teaches a method of improving stability of discharge current in the saw-tooth or needle like type corona discharge device. In this method, each of a plurality of saw tooth or needle like discharge electrodes is connected to a high voltage source through resistor element. However, Japanese Patent Laying-Open No. 5-2314 is silent about what specific resistor element is used, and how such element is formed.

SUMMARY OF THE INVENTION

In view of the problems of the prior art described above, one object of the present invention is to provide a corona discharge device capable of generating uniform and stable discharge even when discharge current is small, and hence capable of reducing amount of generated ozone. It is also an object of the present invention to provide a corona discharge device which can be easily assembled, reducing manufacturing cost.

According to one aspect of the present invention, the corona discharge device includes a plurality of discharge electrodes each having a pointed tip for concentrating electric field, a plurality of resistors and a common electrode, in which each of the plurality of resistors connect corresponding one of the plurality of discharge electrodes to the common electrode, causing a prescribed voltage drop in the range of from 200 V to 2000 V.

According to another aspect of the present invention, the corona discharge device includes a plurality of discharge electrodes each having a pointed tip for concentrating electric field, a first set of plurality of resistor elements, a second set of plurality of resistor elements and a common electrode, in which each of the first set of resistor elements connects corresponding one of the plurality of discharge electrodes to the common electrode, each of the second set of resistor elements connects adjacent discharge electrodes to each other, and the first and second sets of resistor elements cause a prescribed voltage drop in the range of from 200 V to 2000 V between each of the discharge electrodes and the common electrode.

In the corona discharge device in accordance with one aspect of the present invention, each of the plurality of resistors generates a prescribed voltage drop in the range of from 200 V to 2000 V between corresponding one of the discharge electrodes and the common electrode, so that when a high voltage is applied to the common electrode, discharge current from each discharge electrode is made uniform and stable, whereby the dielectric surface can be uniformly charged even with small amount of discharge current, and the amount of generated ozone can be reduced.

In the corona discharge device in accordance with the aforementioned another aspect of the present invention, even if the current value flowing through the first resistor elements vary because of variation of resistance values of the first resistor elements, the second resistor elements serve to compensate for the variation in the current. Therefore, discharge current from each discharge electrode is made uniform and stable, whereby the dielectric surface can be uniformly charged even with a small amount of discharge current, and the amount of generated ozone can be reduced.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 6 is an illustration of a manufacturing process of a corona discharge device in accordance with still another embodiment of the present invention.

FIG. 7 is a perspective view showing assembly of a main portion of a corona discharge device in accordance with a still further embodiment of the present invention.

DESCRIPTION OF THE PREFERRED EMBODIMENTS

Figure 1:
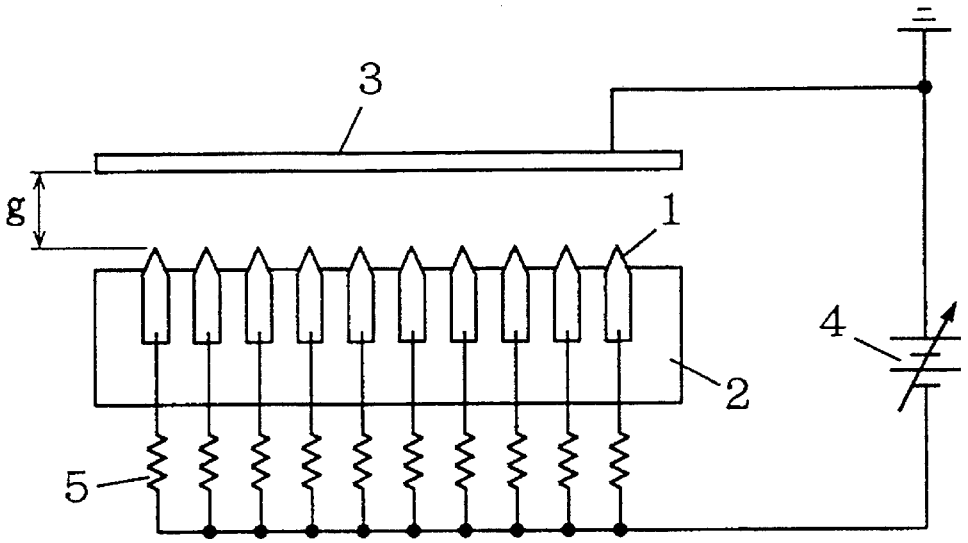
FIG. 1 schematically shows a corona discharge device in accordance with one experimental embodiment of the present invention.

FIG. 1 schematically shows an experimental corona discharge device in accordance with one embodiment of the present invention. In the corona discharge device, 10 saw tooth discharge electrodes 1 are mounted on an insulator substrate 2. These discharge electrodes 1 are formed of stainless steel and arranged at a pitch of 2 mm. Opposing to the saw tooth discharge electrodes 1, a counter electrode 3 of stainless steel is placed spaced apart by a prescribed distance g from the tips of the electrodes 1. Each discharge electrode 1 is connected to a high voltage source 4 through a resistor 5 of 500 MΩ. By application of voltage from high voltage source 4 to saw tooth discharge electrodes 1, corona discharge occurs from saw tooth electrodes 1 to counter electrode 3.

Table 2 shows discharge current from each discharge electrode measured in the corona discharge device of FIG. 1.

TABLE 2

| Electrode No. (from Left) | Discharge Current (μA) |
|---|---|
| 1 | 0.99 |
| 2 | 0.90 |
| 3 | 1.01 |
| 4 | 1.01 |
| 5 | 0.96 |
| 6 | 0.98 |
| 7 | 0.96 |
| 8 | 1.00 |
| 9 | 0.02 |
| 10 | 1.05 |

Figure 20:
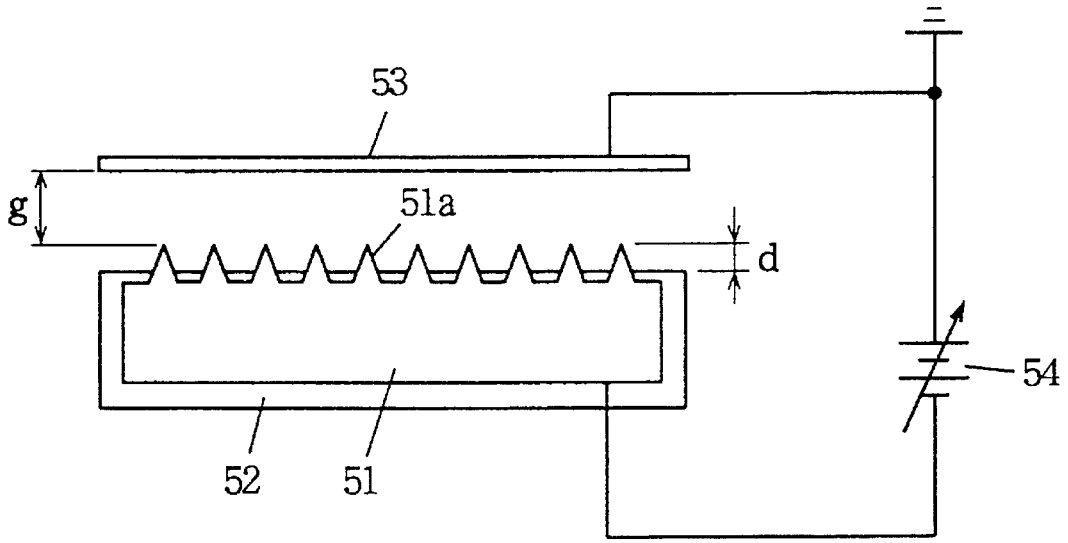
FIG. 20 PRIOR ART
FIG. 20 schematically shows a corona discharge device according to the prior art.

In the measurement of Table 2, discharge current flowing through each discharge electrode 1 during corona discharge was measured by an ampere meter (not shown) connected in series between electrode 1 and high voltage source 4. The voltage applied to discharge electrode 1 was −4.78 kV, and the space g was 7 mm. The left column of Table 2 represents the electrode number counted from the left, and the right column represents discharge current flowing in the corresponding discharge electrode. It is understood from comparison between Tables 1 and 2 that the amount of discharge from respective electrodes of the corona discharge device shown in FIG. 1 is made uniform and stable as compared with the corona discharge device of FIG. 20. The improved discharging characteristics derive from control function of the resistor 5.

Figure 2:
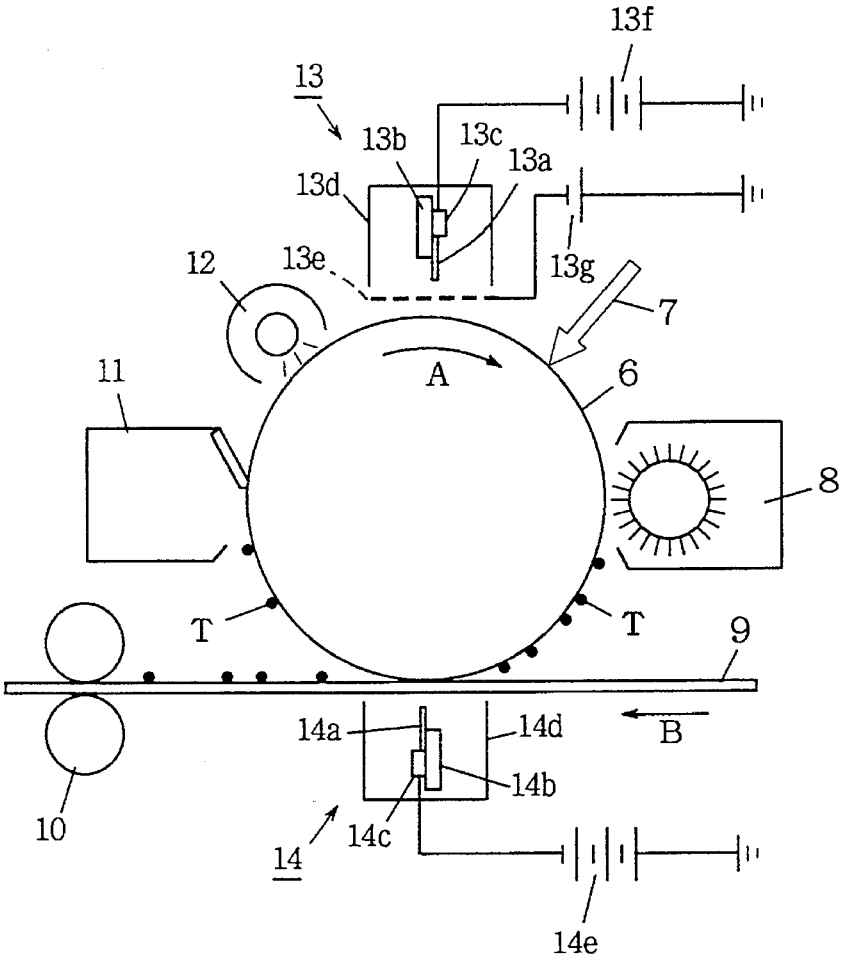
FIG. 2 schematically shows an electrophotographic apparatus employing the corona discharge device in accordance with another embodiment of the present invention.

FIG. 2 schematically shows a main portion of an electrophotographic apparatus such as a copying machine, a laser printer or the like, employing a corona discharge device in accordance with another embodiment of the present invention. The electrophotographic apparatus includes a photoreceptor drum 6 as an image forming body, a developing unit 8, a transfer sheet 9, a fixing unit 10, a cleaner 11, an eraser lamp 12, a corona discharge device 13 as a charger, and a corona discharge device 14 as a transfer unit.

Corona discharge device 13 as a charger includes a plurality of saw tooth discharge electrodes 13*a*, an insulator substrate 13*b*, a plurality of chip resistors 13*c*, a shield case 13*d*, a grid electrode 13*e* and high voltage sources 13*f* and 13*g*.

Corona discharge device 14 as a transfer unit includes a plurality of saw tooth discharge electrodes 14*a*, an insulator substrate 14*b*, a plurality of chip resistors 14*c*, a shield case 14*d* and a high voltage source 14*e*.

Photoreceptor drum 6 is formed of a conductive material such as aluminum, as a base material. A photoconductive layer, for example, of OPC (Organic Photoconductor) is formed on the peripheral surface of the drum. Photoreceptor drum 6 is driven to rotate in a direction denoted by the arrow A about its axis.

Corona discharge device 13 as a charger includes insulator substrate 13*b* supported in a shield case 13*b* having rectangular cross section with one side open, and on insulator substrate 13*b*, a plurality of saw tooth discharge electrodes 13*a* formed of stainless steel and having the thickness of 0.1 mm are mounted. On insulator substrate 13*b*, a common electrode (not shown in FIG. 2) is mounted, and each of the saw tooth discharge electrodes 13*a* is connected to the common electrode through a corresponding chip resistor 13*c*.

Figure 3:
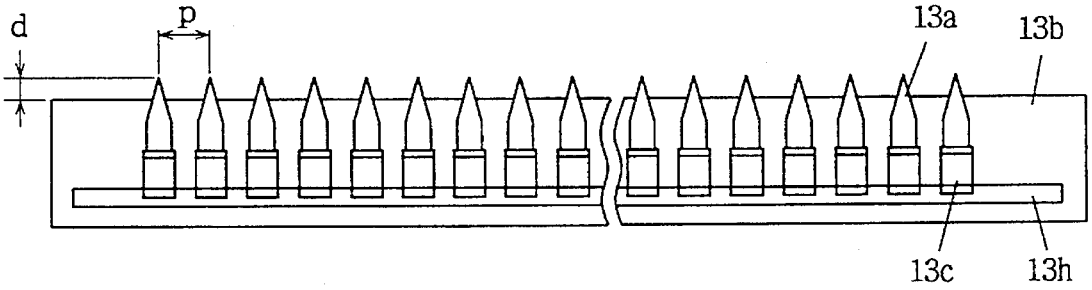
FIG. 3 is an enlarged plan view of a main portion of the corona discharge device used in the electrophotographic apparatus of FIG. 2.

FIG. 3 shows, in enlargement, the main portion of the charger 13 of FIG. 2. On insulator substrate 13*b*, a common electrode 13*h* is provided, and each discharge electrode 13*a* is connected to common electrode 13*h* through a corresponding chip resistor 13*c*. The saw tooth discharge electrodes 13*a* can be formed from a stainless sheet by etching, discharge machining or by laser processing, for example. On insulator substrate 13*b*, 52 discharge electrodes 13*a*, for example, are arranged at a pitch p of 4 mm. The tip of each discharge electrode 13*a* protrudes from the insulator substrate 13*b* by d=2 mm.

Common electrode 13*h* is connected to high voltage source 13*f*, and by applying a voltage to discharge electrodes 13*a* from high voltage source 13*f*, corona discharge is generated from the tips of discharge electrodes 13*a* and the surface of photoreceptor drum 6 is charged. At this time, between discharge electrodes 13*a* and photoreceptor drum 6, a grid electrode 13*e* is placed to which a voltage of about −720 V is applied from the high voltage source 13*g*, and grid electrode 13*e* controls electrostatic potential of photoreceptor drum 6 to be a prescribed potential (for example, about −700 V).

After the surface of photoreceptor drum 6 is charged to a prescribed potential by charger 13, an electrostatic latent image is formed on the surface of photoreceptor drum 6 by exposure light indicated by arrow 7, which electrostatic latent image is developed by developing unit 8.

When the image formed by toner T proceeds towards corona discharge device 14 as the transfer unit, transfer sheet 9 is also fed to the direction of arrow B toward transfer unit 14, timed with the movement of drum 6. Transfer unit 14 is similar to charger 13 except that it does not include a grid electrode, and the transfer unit transfers the toner image on photoreceptor drum 6 onto transfer sheet 9, by charging the rear surface of transfer sheet 9. Transfer sheet 9 on which toner image has been transferred is fed to fixing unit 10. Meanwhile, toner T left on photoreceptor drum 6 is taken away by cleaner 11, and residual charges on photoreceptor drum 6 are removed by eraser lamp 12. Thereafter, photoreceptor drum 6 is again charged by charger 13, to be ready for the next image forming process.

Figure 4:
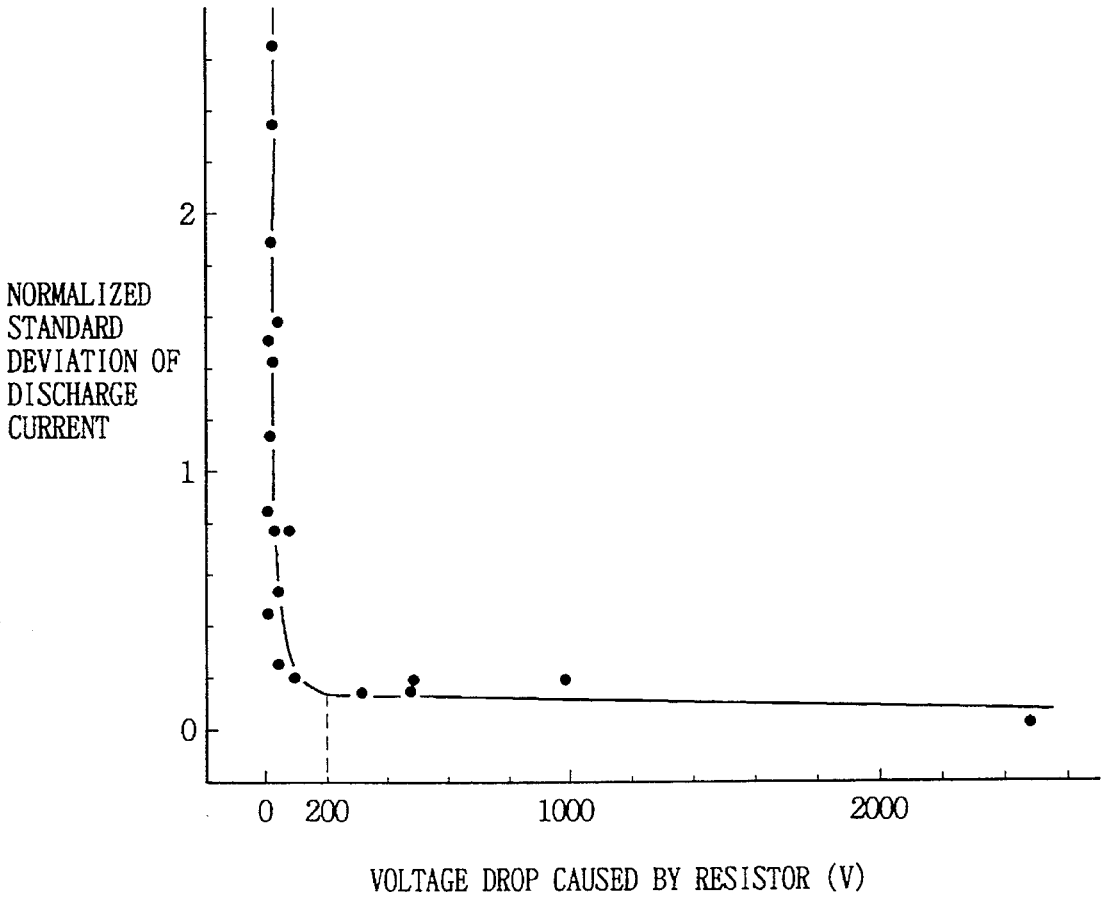
FIG. 4 is a graph showing relation between voltage drop caused by the resistor shown in FIG. 1 and normalized standard deviation of the discharge current.

FIG. 4 is a graph showing relation between voltage drop by the resistor 5 and normalized standard deviation of the discharge current measured by using the experimental corona discharge device of FIG. 1. The abscissa represents voltage drop caused by the resistor 5, and the ordinate represents normalized standard deviation of the discharge current. In the measurement of FIG. 4, 10 MΩ, 50 MΩ, 100 MΩ, 500 MΩ, 1 GΩ and 5 GΩ were used as resistance values of resistor 5, and about 0.1 μA, about 0.5 μA and about 1.0 μA were used as discharge current values per one discharge electrode 1. From the result shown in FIG. 4, it can be seen that variation of the discharge current is reduced and stable state of discharge can be maintained when the voltage drop caused by resistor 5 exceeds 200 V.

The amount of voltage drop caused by resistor 5 necessary to suppress variation in discharge current is influenced by the conditions of discharge such as environment and state of electrode 1. The measurement shown in FIG. 4 was effected at room temperature by using new electrodes 1 formed with high precision by etching. When the corona discharge device is to be used for a long period of time, preferably, the voltage drop caused by resistor should be at least 500 V, taking damage and degradation of electrodes, deposition of foreign matters on the electrodes and change in environment into consideration. However, high voltage source 4 must also supply the voltage to compensate for the voltage drop caused by the resistor 5 in addition to the voltage to be supplied to discharge electrodes 1. Therefore, taking the capacity of high voltage source 4 into account, preferably, the amount of voltage drop caused by resistor 5 should be at most 2000 V.

FIG. 5 shows potential distribution on the drum surface when photoreceptor drum 6 of the electrophotographic apparatus of FIG. 2 is charged. In each graph of FIG. 5, the abscissa represents the distance in the axial direction of the drum by an arbitrary unit, and the ordinate represents surface potential of drum 6. In the measurement related to the graphs of FIG. 5, high voltage source 13*f* was adjusted such that the total discharge current attained 30 μA. The speed of movement of the peripheral surface of the drum was 30 mm/s, and the width of charge was 210 mm.

Figure 5A:
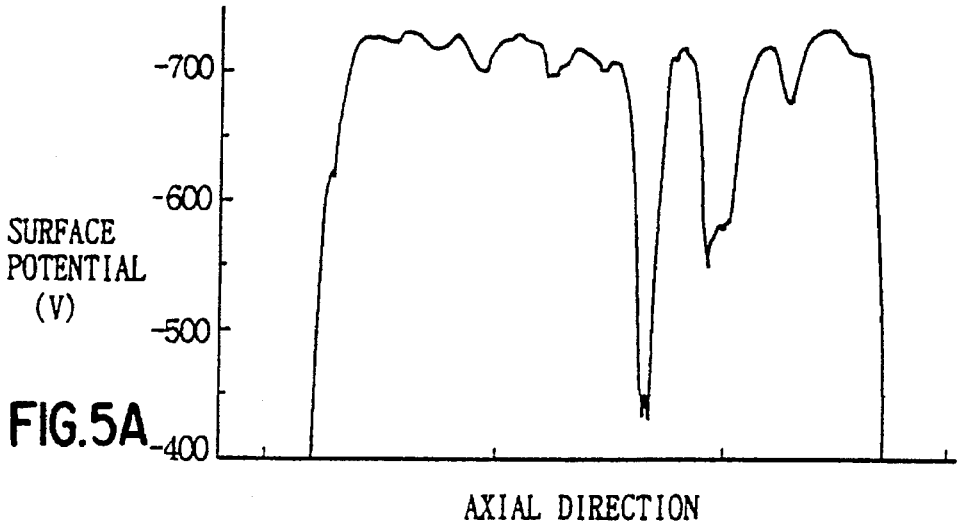
FIG. 5 is a graph showing distribution of electrostatic potential on a photoreceptor drum when the corona discharge device is used under various conditions.
Figure 5B:
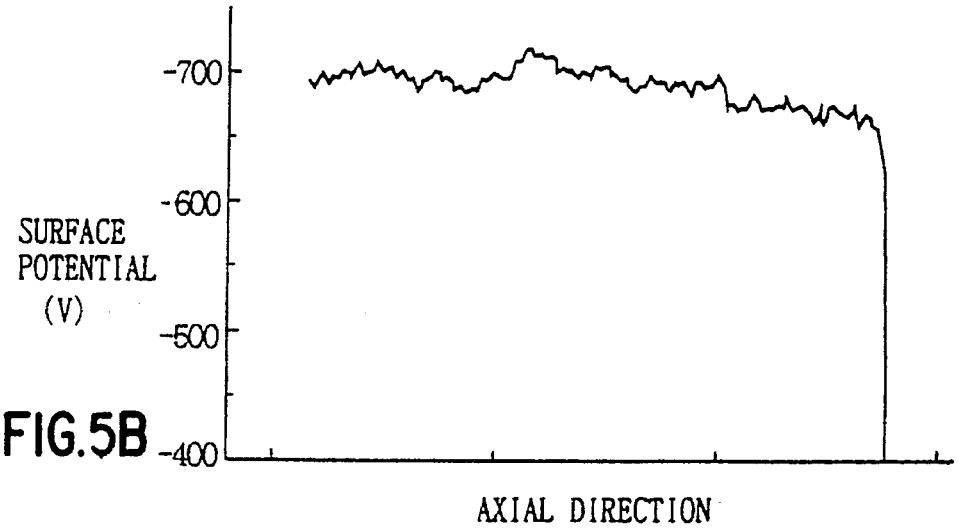
Figure 5C:
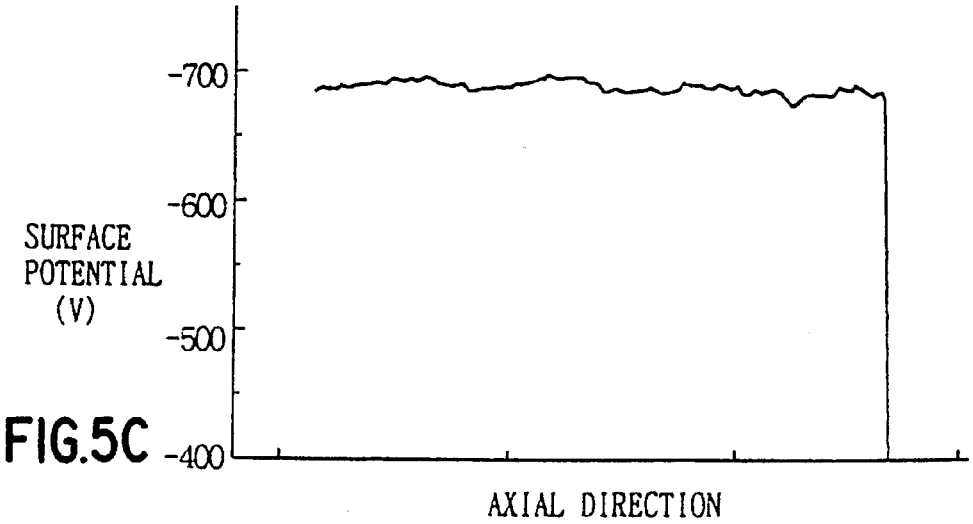

In the example of FIG. 5(A), 102 saw tooth discharge electrodes were directly connected to the common electrode without the resistor. In the example of FIG. 5(B), each of 52 saw teeth discharge electrodes was connected to high voltage source 13*f* through a resistor of 300 MΩ. In the example of FIG. 5(C), each of 52 saw teeth discharge electrodes was connected to high voltage source 13*f* through a resistor of 500 MΩ.

As can be seen from FIG. 5(A), when each discharge electrode was not connected to the resistor, potential distribution on the charge surface of photoreceptor drum 6 was very much uneven. In FIG. 5(B), the resistor of 300 MΩ caused a voltage drop of about 173 V, considerably improving uniformity of potential distribution on drum 6 as compared with the example of FIG. 5(A).

In FIG. 5(C), the resistor of 500 MΩ generated a voltage drop of about 290 V, and the potential ripple on drum 6 was about 20 V, and therefore it is understood that uniformity of charges was further improved as compared with FIG. 5(B).

FIG. 6 shows steps of assembly of the main portion of a corona discharge device in accordance with a still further embodiment of the present invention. (A) and (B) of FIG. 6 show saw tooth discharge electrodes and the common electrode before assembly, respectively. These discharge electrodes and the common electrode can be formed by photoetching a stainless sheet having the thickness of 0.1 mm, for example.

Referring to FIG. 6(A), each of the saw teeth discharge electrodes 21 is connected to common support portion 21*c* through a half etched portion 21*b*. Each discharge electrode 21 has a slit 21*a* for receiving the resistor. The common electrode 22 of FIG. 6(B) is also provided with a plurality of slits 22*a* for receiving a plurality of resistors.

Referring to FIG. 6(C), the discharge electrodes of FIG. 6(A) and the common electrode of FIG. 6(B) are fixed opposing with each other, by an insulator substrate 23. Insulator substrate 23 may be formed of a plastic resin, for example, and the discharge electrodes and the common electrodes are supported fixed on insulator substrate 23 by bonding, injection molding, fusing or the like. After the discharge electrodes of FIG. 6(A) are fixed on insulator substrate 23, common support portion 21*c* is bent and cut away along the half etched portion 21*b*, so that the plurality of discharge electrodes 21 are electrically isolated from each other. This cut and removed common support portion 21*c* may be used as the common electrode.

FIG. 7 is an illustration of an assembly step of the corona discharge device in accordance with a still further embodiment of the present invention, which is similar to FIG. 6. In FIG. 7, on one side of insulator substrate 23, discharge electrodes of FIG. 6(A) are bonded, and thereafter the common support portion 21*c* is removed. In this example, 104 saw teeth discharge electrodes 21 are arranged at a pitch of p=2 mm, and the tip of each discharge electrode protrudes from the bottom of insulator substrate 23 by d=2 mm, for example. On another side surface of insulator substrate 23, common electrode 22 is bonded opposing to discharge electrodes 21. In slit 21*a* of each discharge electrode 21, one end of resistor 24 is inserted, and the other end of resistor 24 is inserted to a corresponding slit 22*a* of the common electrode 22.

Resistor 24 may be formed by using an organic material such as polyethylene, polyester, polyurethane, nylon, polyamide, polyimide, or polyallylether as a base material. A resistor may be formed with low cost by mixing carbon black or metal powder with one of these organic materials. A resistor having high resistance and stable performance not influenced by the change in temperature or moisture may be formed by mixing metal oxide such as zinc oxide, ruthenium oxide or the like in the organic material. Further, a uniform resistor with reduced local variation of resistance value may be formed by mixing alkali metal salt indicating ion conductivity such as halogen-oxyacid salt, per halogen-oxyacid salt, or lithium perchlorate in the organic base material.

The resistor including such an organic base material may be processed to various shapes such as a rod, sheet or the like, and it may be used as the resistor 13*c* shown in FIG. 3.

As to the resistance value of resistor 24 in FIG. 7, about 100 MΩ or higher value is desired which causes voltage drop of several hundred V, in order to sufficiently stabilize discharging.

Resistor 24 formed by using an organic base material is generally relatively soft and resilient, and therefore by inserting with pressure into slit 21*a* of discharge electrode 21 and slit 22*a* of common electrode 22, it can be fixed without using any bonding agent. When resistor 24 is to be pressured-inserted into slits 21*a* and 22*a*, appropriate number of resistors may be simultaneously inserted, so as to reduce time necessary for assembly. After resistors 24 are fixed, resistor 24 as well as slits 21*a* and 22*a* may be covered by a resin mold, so as to prevent adverse influence of moisture.

Figure 8:
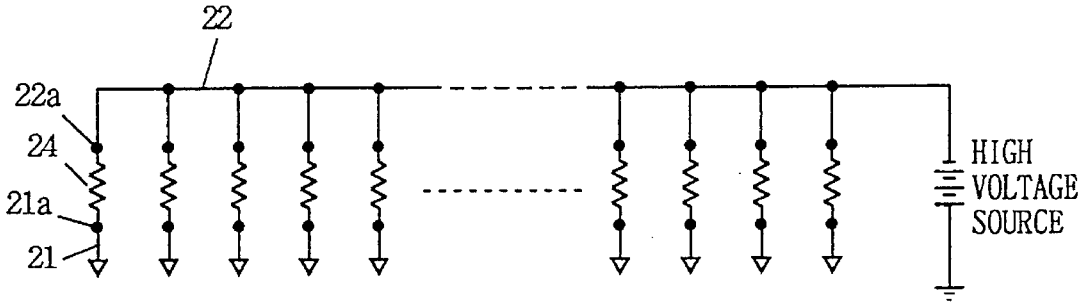
FIG. 8 is an equivalent circuit diagram corresponding to the corona discharge device shown in FIG. 7.

FIG. 8 shows an equivalent circuit diagram of the corona discharge device formed in accordance with the embodiment of FIG. 7. In this equivalent circuit diagram, portions corresponding to FIG. 7 are denoted by the same reference characters.

Figure 9:
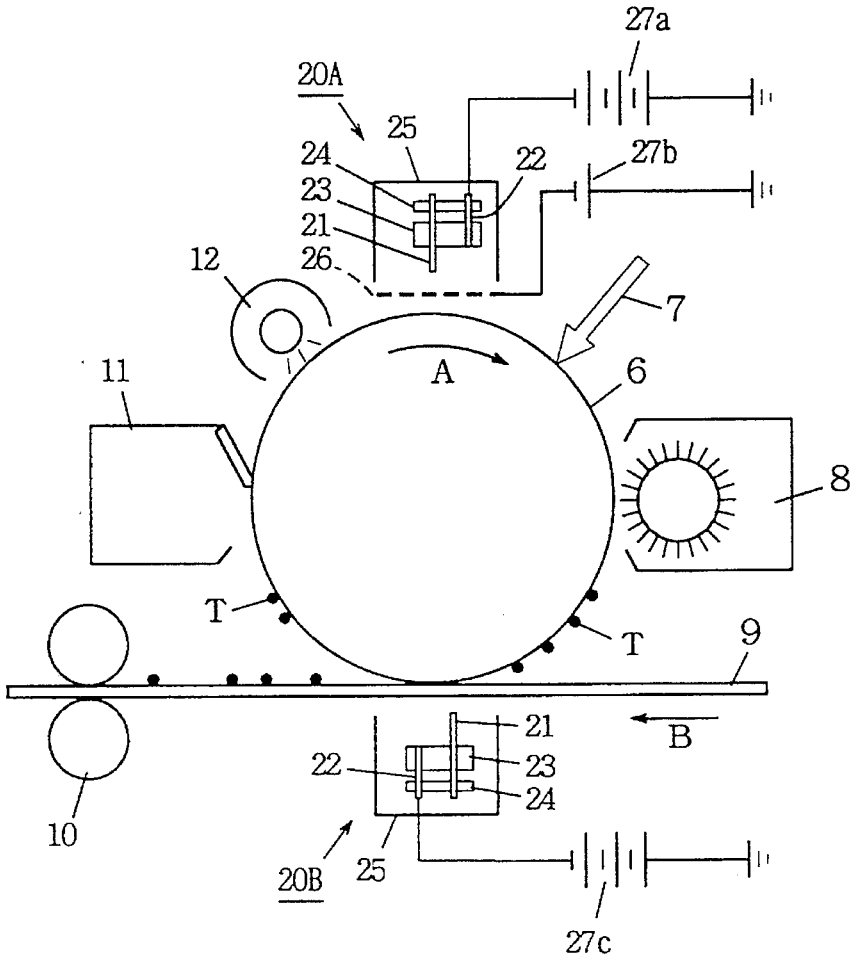
FIG. 9 schematically shows an electrophotographic apparatus employing a corona discharge device in accordance with a still further embodiment of the present invention.

FIG. 9 is similar to FIG. 2 except that the corona discharge device formed in accordance with the embodiment of FIG. 6 is used in the electrophotographic apparatus of FIG. 9. In FIG. 9, portions corresponding to those of FIG. 2 are denoted by the same reference characters. A charger 20A of FIG. 9 includes saw tooth discharge electrodes 21, common electrode 22, insulator substrate 23, resistor 24, shield case 25, grid electrode 26 and high voltage sources 27*a* and 27*b*. Similarly, transfer unit 20B includes saw tooth discharge electrodes 21, common electrode 22, insulator substrate 23, resistor 24, shield case 25 and a high voltage source 27*c*. Since operation of the electrophotographic apparatus of FIG. 9 is the same as that of FIG. 2, detailed description thereof is not repeated.

Figure 10:
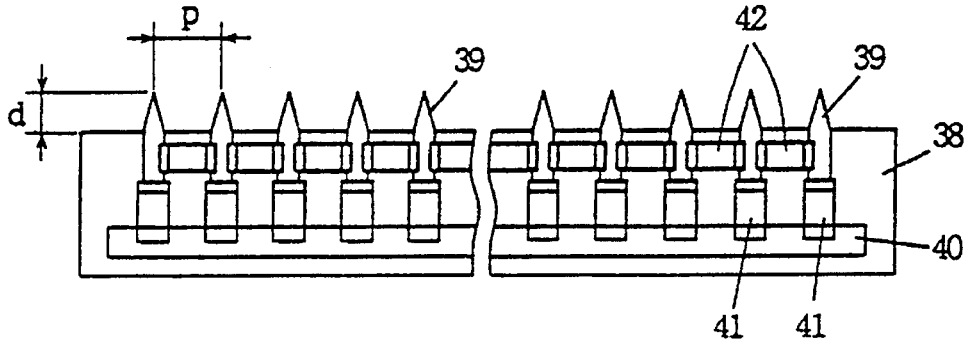
FIG. 10 is a plan view showing a main portion of a corona discharge device in accordance with a still further embodiment of the present invention.

FIG. 10 shows a main portion of a corona discharge device in accordance with a still further embodiment of the present invention. Referring to FIG. 10, a common electrode 40 is formed on an insulator substrate 38, and a plurality of saw tooth discharge electrodes 39 are arranged spaced by a prescribed distance from common electrode 40. As a specific example, 107 discharge electrodes 39 are arranged at a pitch of p=2 mm, and the tip of each electrode 39 protrudes from the side edge of insulator substrate 38 by d=2 mm. Each of 107 discharge electrodes 39 is electrically connected to common electrode 40 through corresponding one of 107 control resistors 41 serving as first resistor elements having the resistance value of about 1.5 GΩ. Further, adjacent two discharge electrodes 39 are electrically connected to each other by corresponding one of 106 bypass resistors 42 serving as second resistor elements having the resistance value of about 500 MΩ. As these resistors, chip resistors generally used as electric circuit parts may be used, or alternatively, resistor formed by using the organic base material mentioned above may be used. In the case that resistors formed by using the organic base material are used, variation of resistance values of 107 control resistors 41 is generally 1.5 GΩ±50%, and variation of 106 bypass resistors 42 is generally 500 MΩ±50%.

Figure 11A:
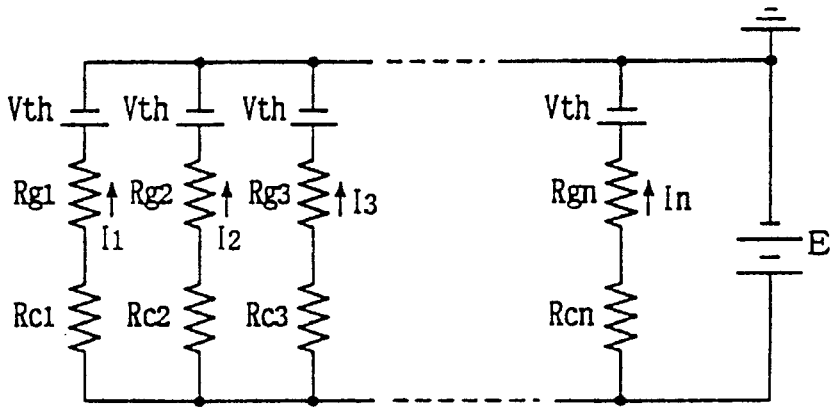
FIG. 11 is an equivalent circuit diagram for simulating amount of discharge in the corona discharge device.
Figure 11B:
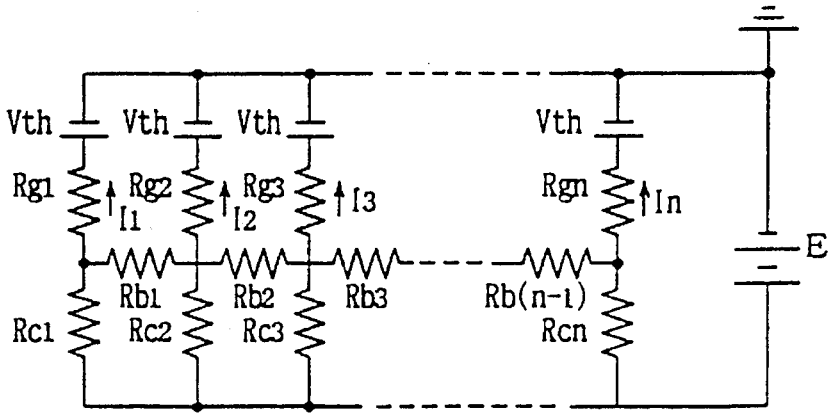

FIG. 11 shows an equivalent circuit diagram used for simulating discharging characteristics of a corona discharge device of the type shown in FIG. 3 and a corona discharge device of the type shown in FIG. 10. The circuit diagram of FIG. 11(A) corresponds to the corona discharge device of the type shown in FIG. 3, while the equivalent circuit diagram of FIG. 11(B) corresponds to the corona discharge device of the type shown in FIG. 10. In these equivalent circuit diagrams, n resistance values $Rc_1$ to $Rc_n$ correspond to n control resistors. n resistance values $Rg_1$ to $Rg_n$ represent gap impedance between each of n discharge electrodes and the counter electrode. The potential Vth represents a threshold voltage for starting discharge. n current values $I_1$ to $I_n$ represent current values discharges from n discharge electrodes, respectively. Further, in FIG. 11(B), (n−1) resistance values $Rb_1$ to $Rb_{(n-1)}$ correspond to bypass resistors.

Figure 12:
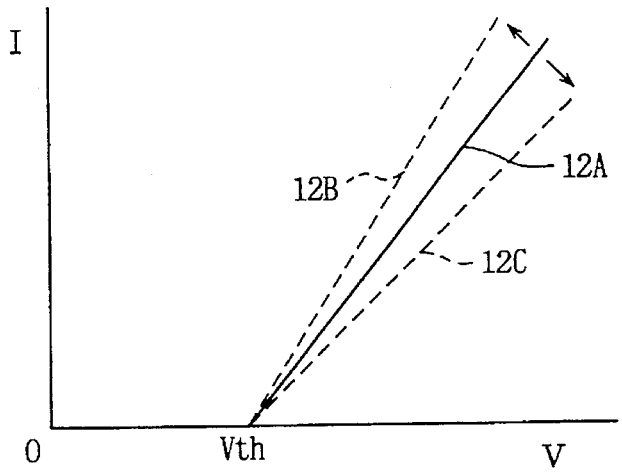
FIG. 12 is a graph showing discharging characteristics of the discharge electrode in the corona discharge device.

FIG. 12 shows results of experiment of discharging characteristics of a corona discharge device having a plurality of discharge electrodes. In this graph, the abscissa represents the voltage applied to the discharge electrodes, and the ordinate represents the discharge current. The discharge characteristic (V-I characteristic) of the corona discharge device has a prescribed threshold voltage Vth necessary for starting discharge, and after the start of discharge, discharge current I increases in proportion to the applied voltage V as shown by a solid line 12A. Here, the threshold voltage Vth for starting discharge is substantially the same in the plurality of discharge electrodes, and the lines representing discharging characteristic after the start of discharge is within the range between two dotted lines 12B and 12C. Gap impedance Rg=(V−Vth)/I differ from electrode to electrode, and the ratio of change is about ±30%. These results of experiment were used as conditions in the simulation using the equivalent circuit of FIG. 11. In the simulation, it is assumed that the ratio of change in resistance (variation of resistance values) of bypass resistance values $Rb_1$ to $Rb_{(n-1)}$ is equal to the ratio of change in resistance of the control resistance values $Rc_1$ to $R_{cn}$.

Figure 13:
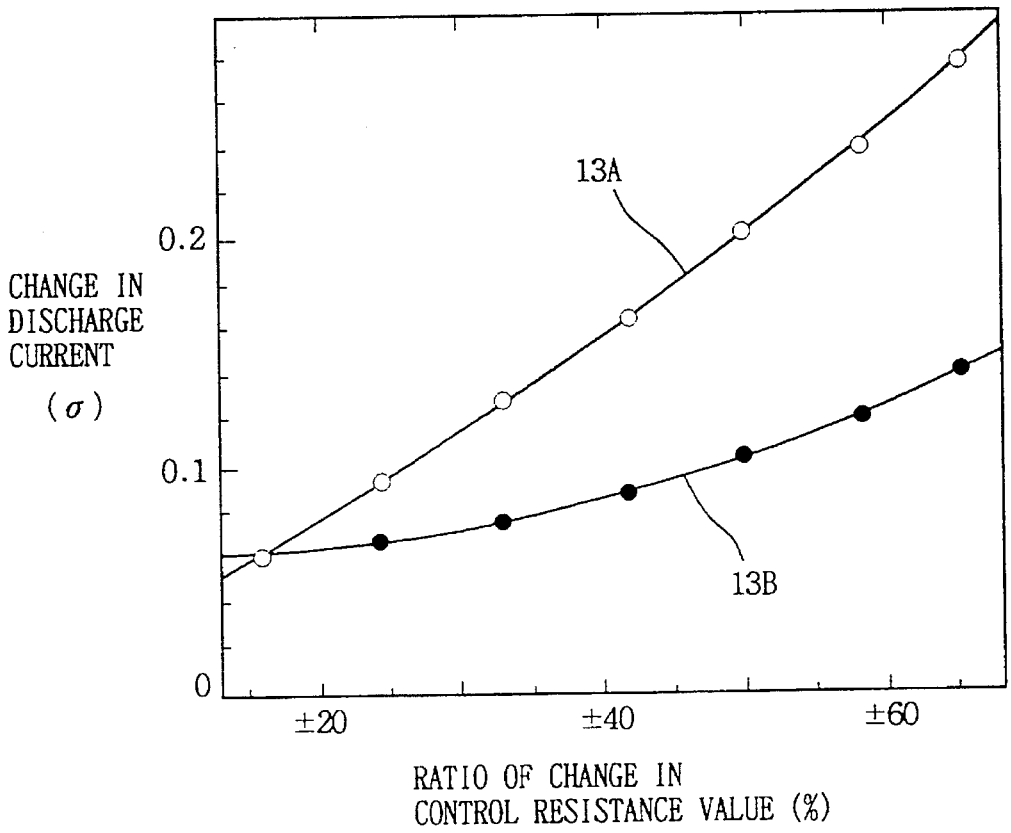
FIG. 13 is a graph showing the result of simulation obtained by the equivalent circuit of FIG. 11.

FIG. 13 is a graph showing the result of simulation using the result of experiment of FIG. 12 and the equivalent circuit of FIG. 11. In this graph, the abscissa represents the ratio of change of control resistance value Rc (variation of resistance values), and the ordinate represents the amount of change of the discharged current in terms of standard deviation σ. Curve 13A represents calculated values in the equivalent circuit of FIG. 11(A), and curve 13B represents calculated values in the equivalent circuit of FIG. 11(B). As is apparent from this graph, when the control resistance value Rc varies by more than ±16%, variations of discharge current I in the equivalent circuit shown in FIG. 11(B) becomes smaller than that in the equivalent circuit of FIG. 11(A). More specifically, as compared with the corona discharge device including control resistors as shown in FIG. 3, the corona discharge device including not only the control resistors but also bypass resistors such as shown in FIG. 10 can further reduce variation of discharge current I, allowing more uniform electrification of the dielectric surface.

Figure 14:
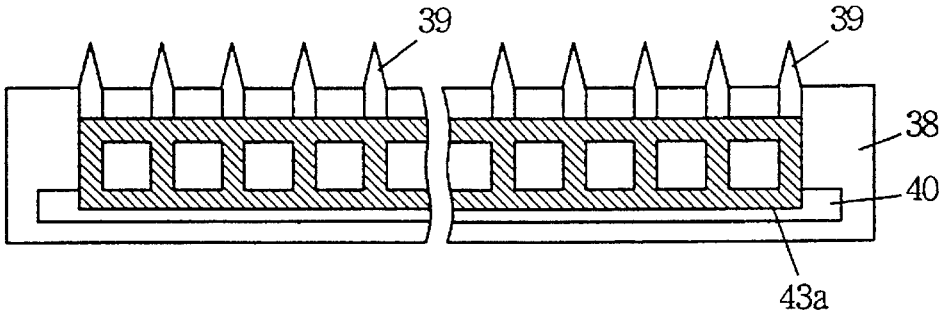
FIG. 14 is a plan view showing a main portion of a corona discharge device in accordance with a still further embodiment of the present invention.

FIG. 14 shows a main portion of a corona discharge device in accordance with a still further embodiment of the present invention. Though the corona discharge device of FIG. 14 is similar to that of FIG. 10, in the device of FIG. 14, the control resistors 41 and bypass resistors 42 of FIG. 10 are formed as a ladder like integrated resistor 43*a*. The integrated resistor 43*a* can be easily formed by pressing a resistor sheet formed by using the organic base mentioned above. Such an integrated resistor has its dimension and size designed such that resistance value between each of discharge electrodes 39 and common electrode 40 is about 1.5 GΩ and resistance value between adjacent discharge electrodes is about 500MΩ. The corona discharge device of FIG. 14 including the integrated resistor can be more easily and quickly manufactured as compared with the corona discharge device of FIG. 10, reducing manufacturing cost.

Figure 15:
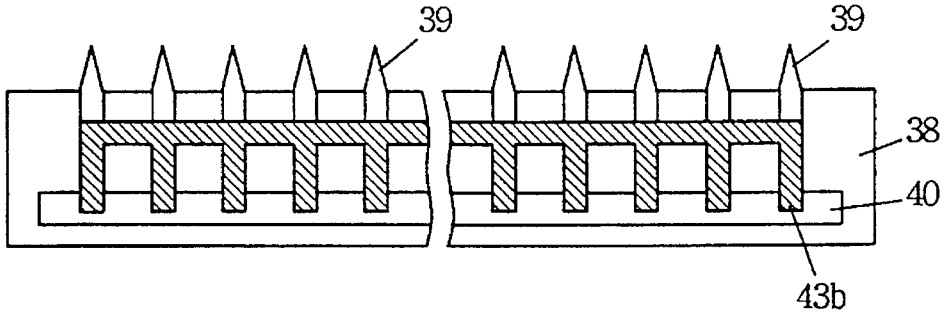
FIG. 15 is a plan view showing a main portion of a corona discharge device in accordance with a still further embodiment of the present invention.

FIG. 15 shows the main portion of a corona discharge device in accordance with a still further embodiment of the present invention. Though the device of FIG. 15 is similar to that of FIG. 14, in FIG. 15, a comb like integrated resistor 43*b* is used instead of the ladder like resistor 43*a* of FIG. 14. It goes without saying that same preferable effects as FIG. 14 can be obtained by the corona discharge device of FIG. 15.

Figure 16:
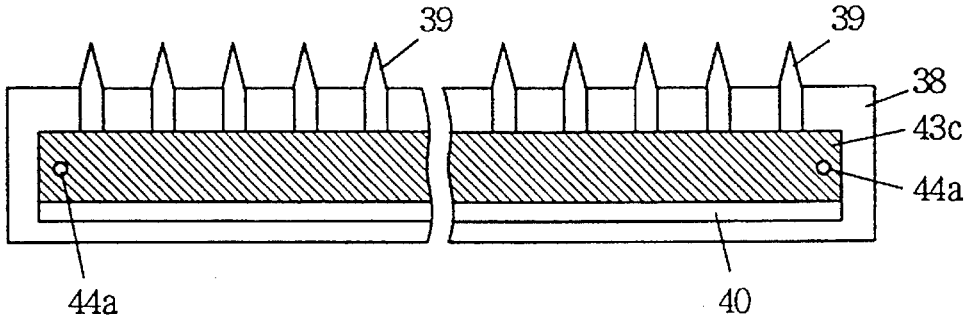
FIG. 16 is a plan view showing a main portion of a corona discharge device in accordance with a still further embodiment of the present invention.
Figure 17:
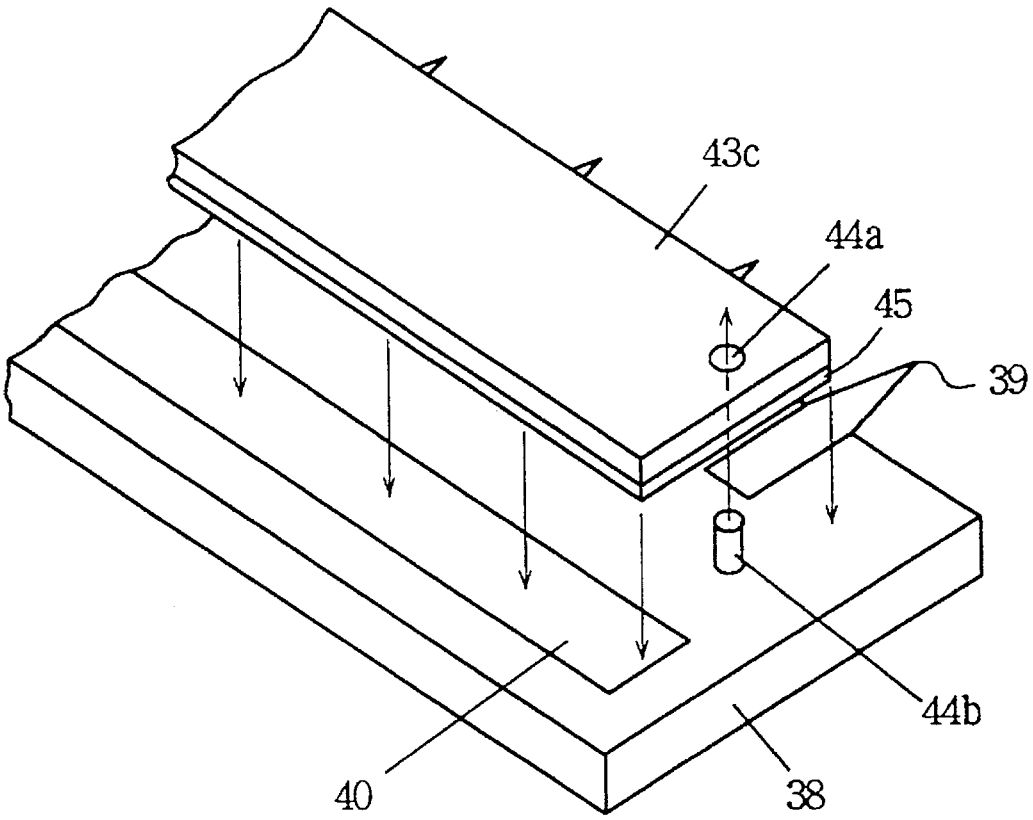
FIG. 17 is a partial perspective view showing an assembly step of the main portion of the corona discharge device in accordance with a still further embodiment of the present invention.

FIG. 16 shows the main portion of a corona discharge device in accordance with a still further embodiment of the present invention. The corona discharge device of FIG. 16 is also similar to those of FIGS. 14 and 15. In the device of FIG. 16, a rectangular integrated resistor 43*c* is used. By such a rectangular integrated resistor 43*c*, similar preferable effects as those of FIGS. 14 and 15 can be obtained. As compared with the ladder like resistor 43*a* or the comb like resistor 43*b*, the rectangular integrated resistor 43*c* can be formed more easily, further reducing manufacturing cost of the integrated resistor. If desired, reference apertures 44*a* for positioning on insulator substrate 38 may be provided on opposing ends in longitudinal direction of the rectangular resistor 43*c*. By utilizing this reference aperture 44*a*, assembly of the corona discharge device can be further facilitated, improving precision in assembly. FIG. 17 is an illustration of an example of an assembly step of the corona discharge device shown in FIG. 16. In this assembly step, integrated resistor 43*c* is electrically connected to discharge electrodes 39 and common electrode 40 through an anisotropic conductive bonding film 45. An anisotropic conductive bonding film 45 is often used for electrical connection in a precise circuit such as liquid crystal panel, and it has conductivity of 0.5Ω along the direction of its depth of 30 μm, and has insulation of $10^{10}$Ω in the direction parallel to its surface.

Substrate 38 has positioning pins 44*b*. Integrated resistor 43*c* is superposed on an anisotropic conductive bonding film 45, positioned by utilizing reference apertures 44*a* and positioning pins 44*b* and subjected to thermo-compression bonding, whereby it can be easily fixed on insulator substrate 38. At this time, integrated resistor 43*c* is electrically connected to discharge electrodes 38 and common electrode 40 by the conductivity in the depth direction of an anisotropic conductive bonding film 45, and a plurality of discharge electrodes 39 are electrically isolated from each other because of insulation of an anisotropic conductive bonding film 45 in the direction parallel to its surface.

Figure 18A:
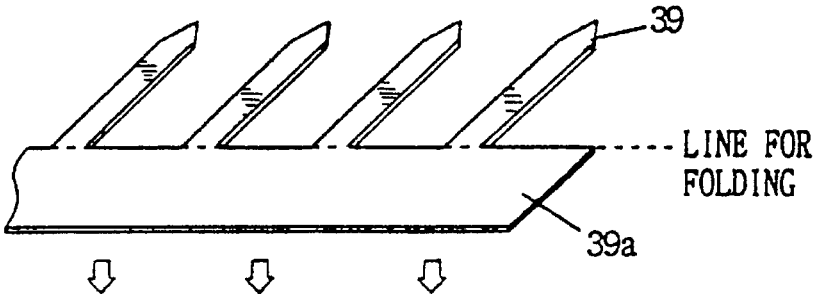
FIG. 18 is a partial perspective view showing an assembly step of the main portion of a corona discharge device in accordance with a still further embodiment of the present invention.
Figure 18B:
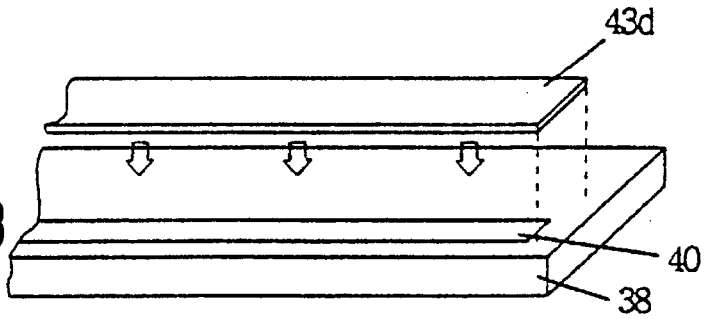
Figure 18C:
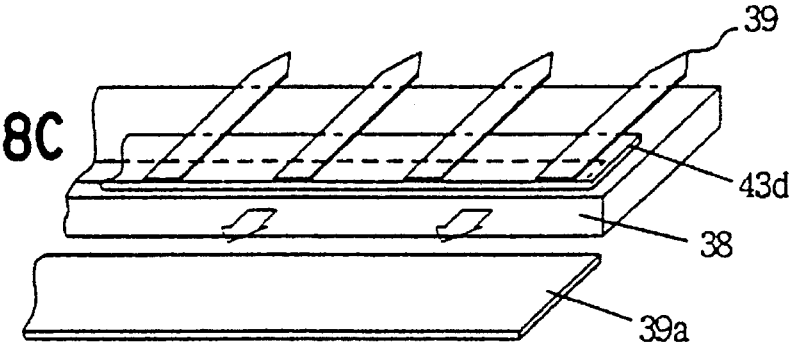

FIG. 18 is an illustration of steps of assembly of the main portion of the corona discharge device in accordance with a still further embodiment of the present invention. Referring to FIG. 18(A), a plurality of discharge electrodes 39 are supported by a support portion 39*a*. At the interface between discharge electrodes 39 and support portion 39*a*, a line for folding is formed by half etching or half laser processing. Referring to FIG. 18(B), on common electrode 40 formed on insulator substrate 38, a rectangular integrated resistor 43*d* is posed. Referring to FIG. 18(C), a plurality of discharge electrodes 39 are superposed on and pressure-bonded or thermo-pressure bonded on integrated resistor 43*d*. After resistor 43*d* and discharge electrodes 39 are securely bonded on insulator substrate 38, support portion 39*a* of discharge electrodes 39 are folded and removed along the line for folding. In this embodiment, discharge electrodes 39 are not in direct contact with the insulator substrate 38, and therefore a conductive substrate may be used instead of the insulator substrate 38.

FIG. 19 shows distribution of surface potential when photoreceptor drum 6 is charged by actually incorporating the corona discharge device of the type shown in FIG. 3 and the corona discharge device of the type shown in FIG. 16 in such an electrophotographic apparatus as shown in FIG. 2. In each graph of FIG. 19, the abscissa represents the distance in the axial direction of photoreceptor drum 6 by an arbitrary unit, and the ordinate represents surface potential. In the corona discharge devices of the types shown in FIGS. 3 and 16, the resistor was formed by a resin film of the polyallylether type. The resistance value of control resistor element was within the range of about 500 MΩ±30%, and the resistance value of bypass resistor element was within the range of about 150 MΩ±30%. The OPC surface of photoreceptor drum 6 having the diameter of 50 mm was moved by 86 mm/s and the total amount of discharge current was set to 100 μA.

Figure 19A:
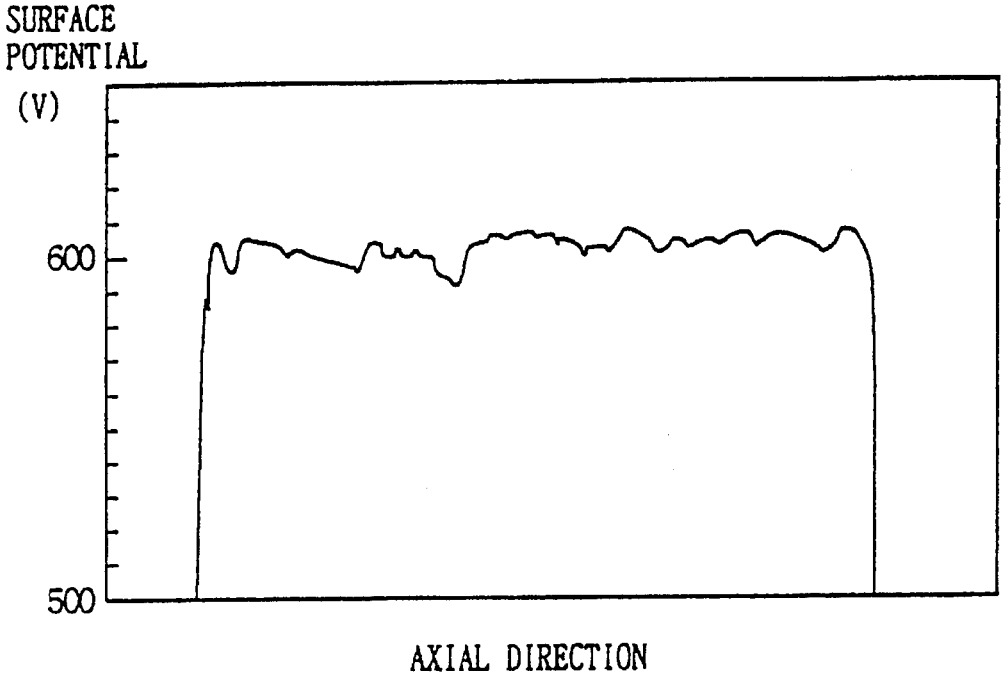
FIG. 19 is a graph showing distribution of electrostatic potential on a photoreceptor drum when the corona discharge devices of FIGS. 3 and 16 are used.
Figure 19B:
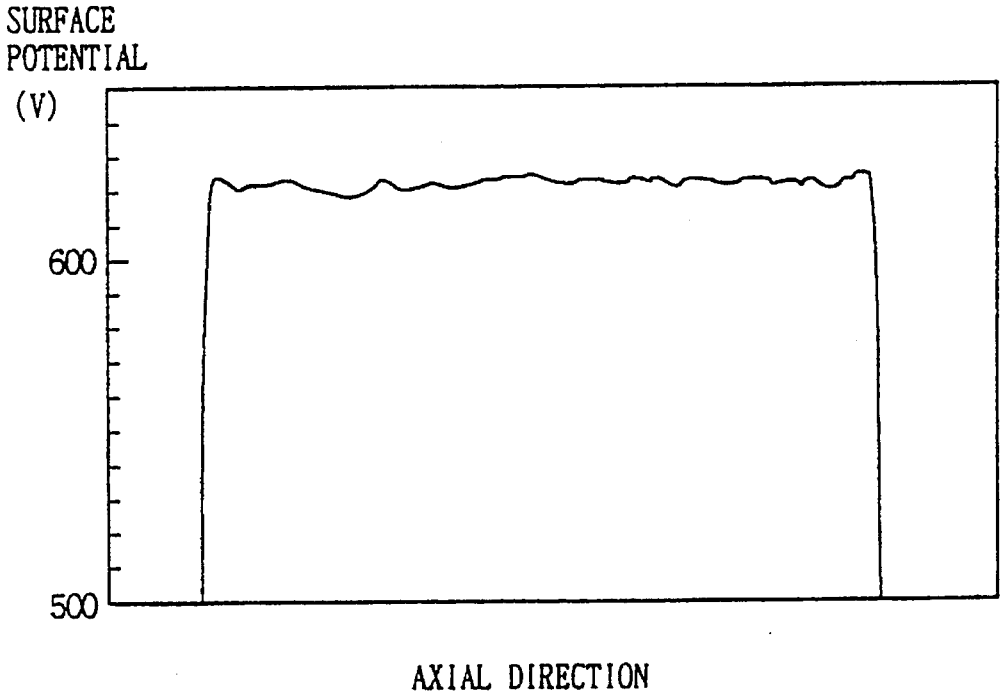

The graph of FIG. 19(A) corresponds to the corona discharge device of the type shown in FIG. 3, while the graph of FIG. 19(B) corresponds to the corona discharge device of the type shown in FIG. 16. As can be seen from these graphs, in the corona discharge device of the type shown in FIG. 3, surface potential ripple of 16.6 V was generated along the axial direction of photoreceptor drum, while the surface potential ripple as small as 7.8 V was generated in the corona discharge device of the type shown in FIG. 16. More specifically, as compared with the corona discharge device including the control resistor shown in FIG. 3, the corona discharge device including not only the control resistor element but also bypass resistor elements such as shown in FIG. 16 can more uniformly charge the surface of the photoreceptor drum 6.

Though corona discharge devices having saw tooth discharge electrodes have been described in the above embodiments, the present invention may be applied to corona discharge devices having comb like or needle like discharge electrodes. Though the corona discharge device in accordance with the present embodiment was mainly used as a charging device for electrophotographic apparatus in the above embodiments, the corona discharge device in accordance with the present invention may be used in a transfer unit, an erasure unit, or a separating unit of an electrophotographic apparatus.

As described above, according to the present invention, a corona discharge device capable of generating stable discharge even with a small amount of discharge current and hence capable of reducing amount of ozone can be provided. Further, the corona discharge device of the present invention can be formed easily and quickly, so that manufacturing cost of the corona discharge device can be reduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A corona discharge device, comprising a plurality of discharge electrodes separated from each other, each having a pointed tip for concentrating electric field, a plurality of resistors, and a common electrode, wherein each of said plurality of resistors connects corresponding one of said plurality of discharge electrodes to said common electrode, and generates a prescribed voltage drop in a range of from 200 V to 2000 V.

2. The corona discharge device according to claim 1, wherein said resistor includes an organic base material including one selected from the group consisting of polyethylene, polyester, polyurethane, nylon, polyamide, polyimide, polycarbonate and polyallyether, and said organic base material includes at least one kind of powder selected from the group consisting of carbon black, metal powder, zinc oxide powder, ruthenium oxide powder, halogen-oxyacid salt powder, per halogen-oxyacid salt powder and lithium perchlorate powder.

3. The corona discharge device according to claim 1, wherein said plurality of discharge electrodes are mounted along one side surface of an insulator substrate;

each of said discharge electrodes has a slit for receiving one of said resistors;

said common electrode has a plurality of slits for receiving said resistors, and mounted opposing to said discharge electrodes on said insulator substrate; and each of said resistors is fit in the slit of the corresponding one of said discharge electrodes and in the corresponding slit of said common electrode.

4. The corona discharged device of claim 1, wherein said pointed tip of each of said discharge electrodes has a triangular shape.

5. The corona discharged of claim 1, wherein said discharge electrodes are formed of stainless steel.

6. A corona discharge device, comprising a plurality of discharge electrodes each having a pointed tip for concentrating electric field, a first set of plurality of resistor elements, a second set of plurality of resistor elements and a common electrode, wherein each of said first set of resistor elements connects corresponding one of said plurality of discharge electrodes to said common electrode, each of said second set of resistor elements connect adjacent said discharge electrodes to each other, and said first and second sets of resistor elements cause a prescribed voltage drop within a range of from 200 V to 2000 V between each of said discharge electrodes and said common electrode.

7. The corona discharge device according to claim 6, wherein said first and second sets of resistor elements include an organic base material including at least one organic material selected from the group consisting of polyethylene, polyester, polyurethane, nylon, polyamide, polyimide, polycarbonate and polyallyether, and said organic base material includes at least one kind of powder selected from the group consisting of carbon black, metal powder, zinc oxide powder, ruthenium oxide powder, halogen-oxyacid salt powder, per halogen-oxyacid salt powder and lithium perchlorate powder.

8. The corona discharge device according to claim 6, wherein said first and second sets of resistor elements are formed as a ladder like integrated resistor.

9. The corona discharge device according to claim 6, wherein said first and second sets of resistor elements are formed as a comb like integrated resistor.

10. The corona discharge device according to claim 6, wherein said first and second sets of resistor elements are formed as a rectangular integrated resistor.

11. The corona discharge device according to claim 10, wherein said integrated resistor element is electrically connected to said discharge electrodes and said common electrode through an anisotropic conductive bonding film.

12. The corona discharge device of claim 6, wherein each of said first set of resistor elements has a resistance value in the range of 1.5 GΩ±50% and each of said second set of resistor elements has a value in the range of 500 MΩ±50%.

* * * * *